US005271204A

United States Patent [19]

Wolf et al.

[11] Patent Number: 5,271,204

[45] Date of Patent: Dec. 21, 1993

[54] LIGHTWEIGHT DISPLAY POST AND METHOD OF MAKING SAME

[76] Inventors: Morris A. Wolf, 7048 Macapa Dr., Los Angeles, Calif. 90068; Leo Wolf, 10355 Cheviot Dr., Los Angeles, Calif. 90064

[21] Appl. No.: 823,352

[22] Filed: Jan. 21, 1992

[51] Int. Cl.[5] ..... E04C 3/02

[52] U.S. Cl. ..... 52/730.1; 52/730.5; 52/730.6; 52/731.3; 52/731.4; 52/731.8; 52/732.2; 52/732.3

[58] Field of Search ..... 52/726.4, 730.1, 730.4, 52/730.5, 730.6, 731.1, 731.2, 731.3, 731.4, 731.5, 731.7, 731.8, 731.9, 732.1, 732.2, 732.3

[56] References Cited

U.S. PATENT DOCUMENTS

| | | | |
|---|---|---|---|
| 3,222,841 | 12/1965 | Lipof | 52/731.5 |
| 3,370,389 | 2/1968 | Macaluso | 52/731.5 X |
| 3,398,499 | 8/1968 | Moore et al. | 52/732.2 |
| 3,728,837 | 4/1973 | Kiefer, Jr. | 52/732.2 |
| 3,866,381 | 2/1975 | Eschbach et al. | 52/731.5 X |
| 4,712,286 | 12/1987 | Wolf | 52/588 X |
| 4,905,422 | 3/1990 | Daniels | 52/588 |
| 5,095,678 | 3/1992 | Murphy | 52/731.5 |

*Primary Examiner*—Carl D. Friedman
*Assistant Examiner*—Matthew E. Leno

[57] ABSTRACT

An improved merchandise display structure of the type having upright posts and transverse connecting struts, each post having longitudinal series of mounting slots in the bottoms of grooves formed in the sides of the posts to receive hanger brackets and other display accessories as well as panels that can be supported in the grooves in the posts and the struts. The preferred post construction is formed by two identical one-piece strips of lightweight sheet metal that are of generally V-shaped cross-sectional shape, each forming two grooved sides of a square post. The opposite longitudinal edges of each strip are formed as a channel-shaped bend and a tongue for interfitting with the channel-shaped bend of the other strip when turned end-for-end, and are secured together in a stitching operation. Each V-shaped strip has a channel-shaped corner bend simulating a tongue-and-groove joint for symmetry and extra strength. To adapt the lightweight material for use with standard slot hardware designed for heavier material, the end of each slot in the bottom walls of the grooves may be offset to double the effective wall thickness of the material as well as to increase its strength. The method of the invention provides an elongated multiple-length strip of the bent material, cuts the strip into a plurality of post-length strips, pairs off the strips and turns one end-for-end, and stitches the strips together. A second embodiment of the invention uses four substantially flat one-piece strips, each having a central groove, a channel-shaped bend along one edge and a tongue along the other, two of the four strips being turned end-for-end before stitching. Optional decorative corner covers are provided in different corner shapes to be slid onto the posts. The preferred lightweight sheet metal is sixteen gauge (about 0.60 inch), which can be used with standard slot hardware designed for either sixteen gauge or the heavier eleven gauge (about 0.120 inch). The groove bottom walls at the opposite ends of the slots are offset and effectively doubled in thickness for standard eleven-gauge hardware.

28 Claims, 3 Drawing Sheets

FIG. 12.
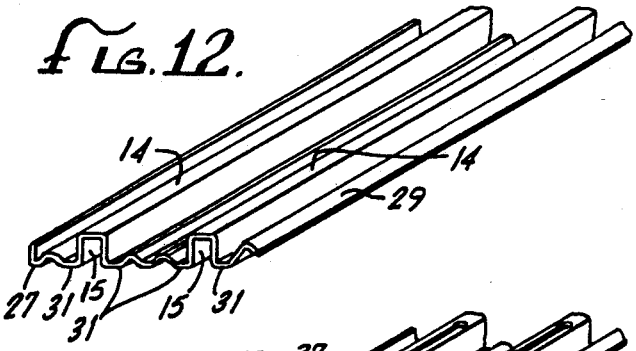
FIG. 13.
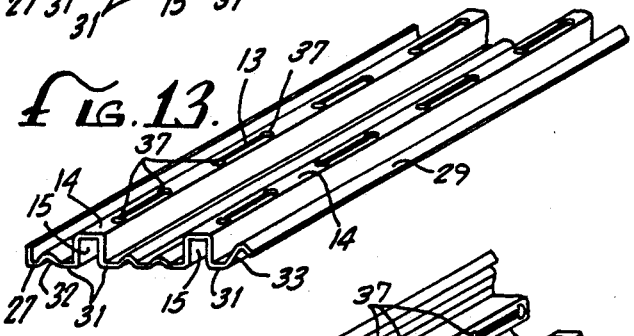
FIG. 14.
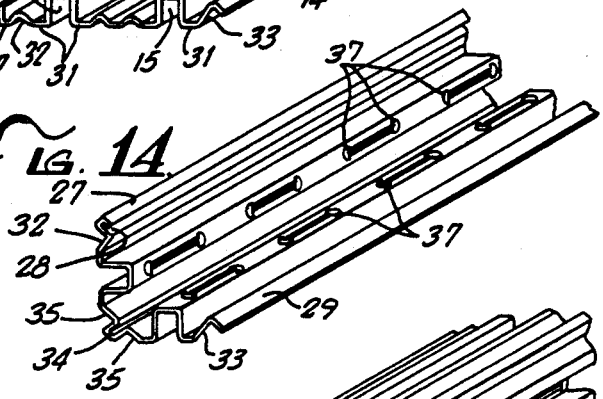
FIG. 15.
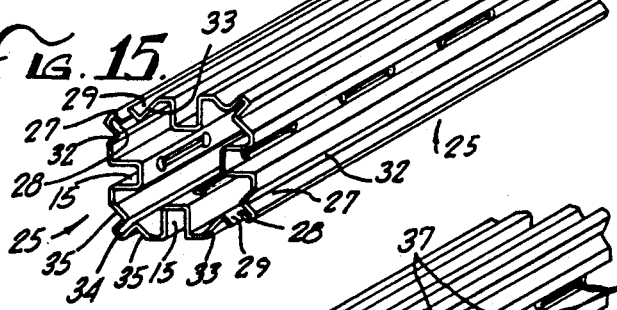
FIG. 16.
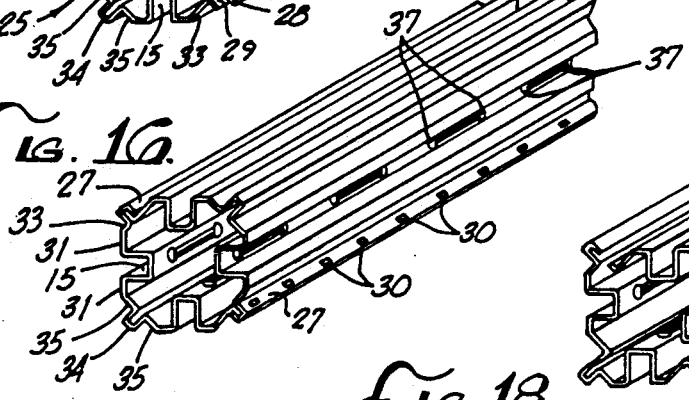
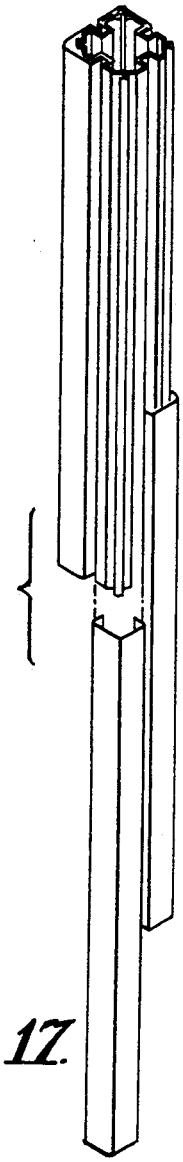
FIG. 17.
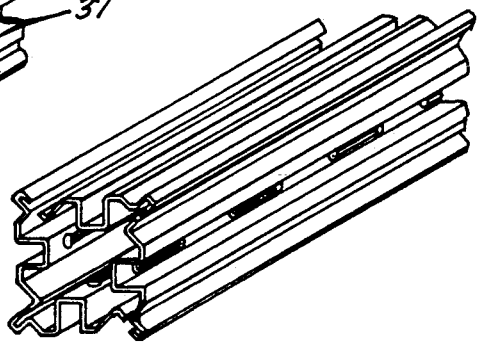
FIG. 18.

LIGHTWEIGHT DISPLAY POST AND METHOD OF MAKING SAME

BACKGROUND OF THE INVENTION

This invention relates to the construction of elongated hollow posts for use in structural systems, and particularly to posts for use in display systems in the merchandising field and in other structural systems where decorative appearance and structural strength are important. These systems include structures and frameworks that serve as supports and backgrounds for merchandise that is offered for sale in establishments of various kinds, such as department stores and other retail stores, and for related structures in such stores.

Prior display systems of this general type have included the system shown in U.S. Pat. No. 4,133,433 in which relatively heavy extruded aluminum posts are formed with longitudinal mounting grooves in four sides. Each groove has a slotted bottom wall for receiving hook-like connecting elements of accessories such as brackets to be mounted on the posts, or similarly-shaped connecting elements on board-like struts for connection to the posts in a display structure, or a dressing room or other related structure. The grooves also are positioned and sized to receive the edges of panels that can form walls in display structures.

A lighter and less expensive post and strut construction is disclosed in U.S. Pat. No. 4,712,286 wherein a four-sided post is with longitudinal mounting groove formed by four lightweight, predecorated sheet metal strips, each bent to form one corner section of the post. This construction relied upon overlapping of the edge portions of the four corner sections within the mounting grooves for double-walled slotted bottom walls in the grooves, in an effort to provide the structural strength needed to carry the loads experienced in normal service use. Unfortunately, this double thickness of lightweight metal was not sufficient to provide the desired strength in lightweight posts.

In each of these patented systems, the struts were formed in a manner similar to the posts and provided with screw-operated tightening mechanisms for securing the posts and struts tightly together. In both the tightening mechanisms and the accessory elements, the connecting elements are of a standard type, comprising tabs that extend through the slots with notches in their undersides for fitting snugly over the slotted walls at the lower ends of the slots.

Other slot hardware systems for such accessories also exist, typically using relatively heavy sheet metal uprights in the form of tubes or mounting strips with slots sized and spaced in accordance with one of the two popular standards that are used throughout the world. One is a heavy-duty system that uses one-inch long slots spaced on two-inch centers, and the other uses one-half inch slots on one-inch centers, this frequently being used for lighter duty systems. For the heavy-duty systems, the most commonly used weight of material is eleven gauge sheet metal that is about 0.120 of an inch in thickness. The light-systems also may use eleven gauge sheet metal, or if there is no need for high load-carrying capacity, lighter and less expensive sixteen gauge sheet metal sometimes is used. This is about 0.060 of an inch thick.

SUMMARY OF THE INVENTION

The objective of the present invention is to provide a significantly improved system in which relatively inexpensive thin-walled material may be used for economy and lightness in weight, with a relatively high degree of overall strength comparable to prior systems made with heavier material, and at the same time readily adaptible to receive standard slot hardware accessories designed for use with the heavier systems as well. To these ends, the present invention provides a grooved display post that is formed by at least two elongated thin-wall strips that are bent and shaped to special cross-sectional shapes that define the slotted grooves as U-shaped bends in sidewalls of the post and have special corner shapes that not only add significant stiffness and strength to the post but also comprise the joints for securing the elongated strips together. These special shapes preferably are identical, with one strip being turned end-for-end for assembly, thus making the manufacturing process relatively efficient and economical.

More specifically, as embodied in the preferred embodiment of the invention, the novel display post comprises two elongated strips that are generally V-shaped in cross-section so that each forms two grooved sides of a post, and each strip has one longitudinal edge portion that is channel-shaped to define a joint groove and an opposite longitudinal edge portion that is bent outwardly to form a narrow strip, or tongue, for fitting into the joint groove in an adjacent channel-shaped bend when the strip is turned end-for-end and aligned with the first strip. Then the two strips, with their tongues and channel-shaped bends interfitted, are secured together preferably by a joining operation such as stitching which clamps and deforms the interfitted edge portions. The two strips of identical cross-sectional shape can be sections of the same roll-formed piece of material, which is highly advantageous from a cost viewpoint.

For symmetry, the preferred embodiment has an integral, channel-shaped bend of the same external shape as the joint-forming bends in the two strips, so that all four corners have the same external configuration. These extra bends also contribute significantly to the strength of the post. An alternative embodiment, less favored because of an increased number of parts and an additional assembly operation, uses four strips with tongue-and-channel joints at all four corners.

To adapt the lighter thin-walled material for use with standard accessories designed for heavier material, the groove bottom wall at the lower end of each slot is effectively doubled in thickeness by an inwardly offset bead that has an inside wall that is spaced from the outside of the bottom wall by the thickness of the heavier material. This has been found to increase the strength as well as the effective thickness. For reversability, an offset is formed at both ends of each slot.

Decorative corner covers are provided for the posts, with various outside shapes for providing different appearances. These covers are of lightweight material, preferably sheet metal which is bent to form the desired corner shape between two free edges that are disposed at the correct angle to be inserted in adjacent grooves and to engage the walls of the grooves to hold the corner covers in place. Generally square, rounded and octagonal posts are provided with different cover shapes.

The method of the present invention resides in the steps of providing a strip of the thin-wall sheet material of predetermined width and long enough to form a plurality of post lengths, bending the strip to the novel shape to define the U-shaped grooves and the corner joint portions, slotting the bottom walls and forming the offset beads if thickening is desired, cutting the strip into a plurality of post-length pieces, turning half the pieces end-for-end and aligning the joint grooves and tongues, and securing the tongues in the grooves. This method can be performed with two of the preferred right-angle strips per post, or with four separate single-side strips. Corner covers are bent to the desired shape and fitted over the corners, either by spreading resiliently flexible metal or, preferably, by slipping them endwise over the corners.

Other aspects and advantages of the invention will become apparent from the following detailed description, taken in conjunction with the accompanying drawings.

BRIEF DESCRIPTION OF THE DRAWINGS

FIG. 12 is a fragmentary perspective view of an early step in the method, showing the bending of a strip of metal to form two U-shaped mounting grooves and the opposite edge portions to form joint elements;

FIG. 13 is a fragmentary perspective view similar to FIG. 12 showing the adding of the slots and the offset beads to the bent strip;

FIG. 14 is a fragmentary perspective view similar to FIGS. 12 and 13 showing the right-angle bending of the strip;

FIG. 15 is a fragmentary perspective view showing two pieces of the bent strip, one cut off and turned end-for-end preparatory to assembly into a post;

FIG. 16 is a fragmentary perspective view showing the two pieces of FIG. 15 after the stitching operation one of the joints;

FIG. 17 is a perspective view of a post illustrating the assembly of corner covers over two of the corners, after two covers have been installed; and FIG. 18 is a fragmentary perspective view similar to FIG. 15 illustrating the positioning of four single-side strips for assembly into a post of the kind shown in FIGS. 10 and 11.

DETAILED DESCRIPTION OF THE PREFERRED EMBODIMENT

Figures 1, 2, 3, 4:
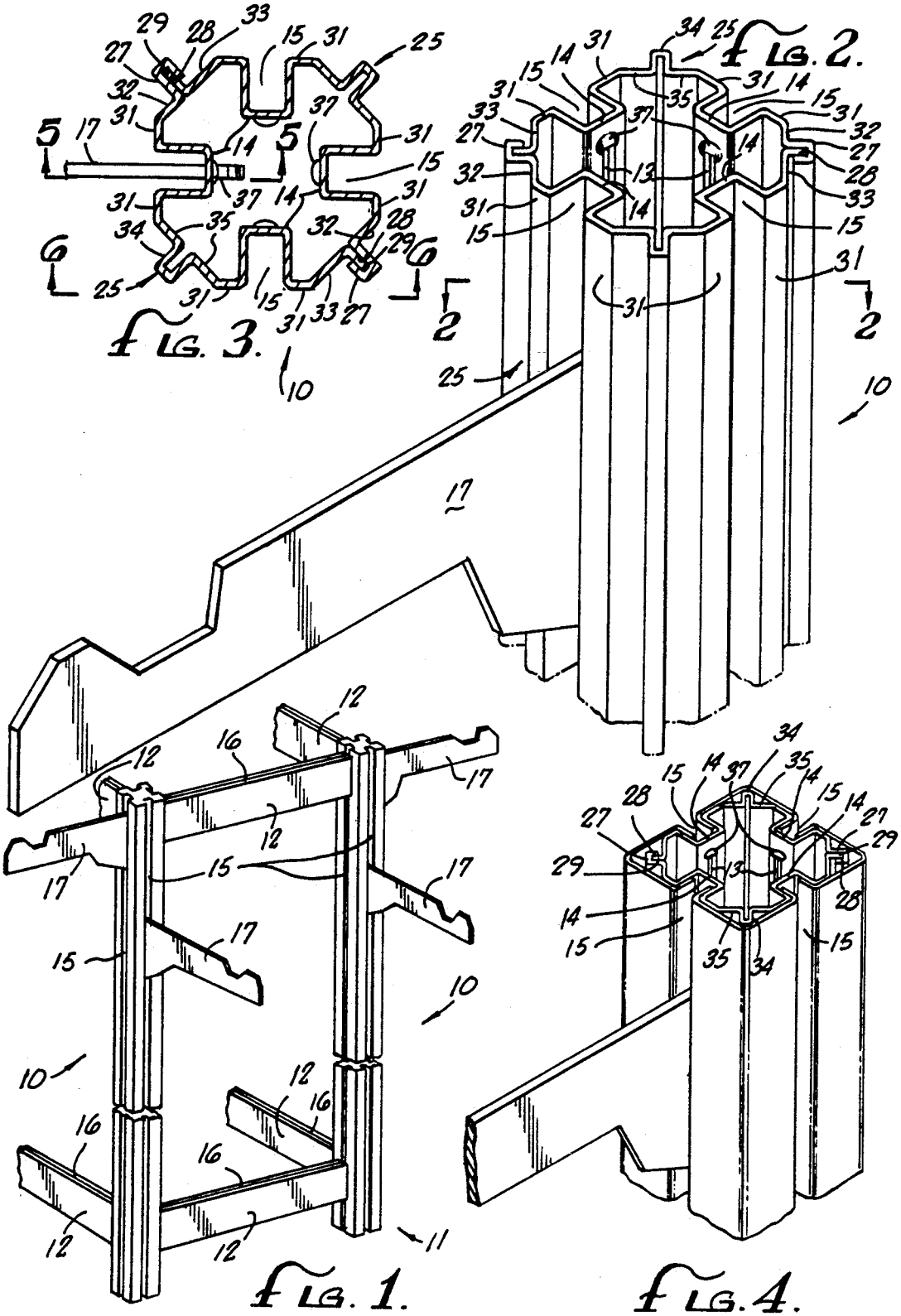
FIG. 1 is a fragmentary perspective view of one end section of a representative merchandising display structure, equipped with illustrative accessory brackets and constructed with display posts embodying the novel features of the present invention, the post construction being shown diagrammatically and with portions cut away for compactness.
FIG. 2 is an enlarged, fragmentary perspective view of a section of the preferred embodiment of the post of the present invention, shown without corner covers and with one accessory bracket installed in a mounting groove.
FIG. 3 is a fragmentary cross-sectional view of the post of FIG. 2, taken substantially along the line 2—2 and shown on a reduced scale.
FIG. 4 is a fragmentary perspective view similar to FIG. 2 on a reduced scale with generally rectangular corner covers installed and with part of the bracket broken away.

As shown in the drawings for purposes of illustration, the invention is embodied in two posts, indicated generally by the reference number 10 in FIGS. 1 and 4, shown in the position of upright corner posts in a framework 11 that also includes a plurality of crosspieces 12 in the form of horizontal struts that are joined at their ends to the posts 10. These struts can be constructed in the manner disclosed in the aforesaid patents, with screw mechanisms (not shown) securing the struts in slots 13 in the bottom walls 14 of longitudinal grooves 15 in the sides of the posts.

Figure 5:
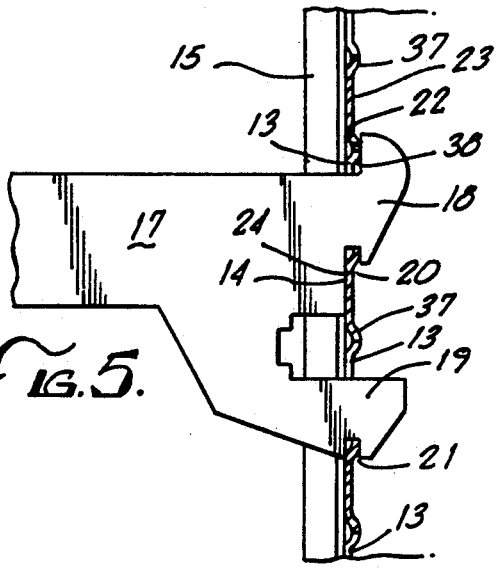
FIG. 5 is a fragmentary cross-sectional view taken substantially along line 5—5 of FIG. 3.

In addition, illustrative display accessories 17, herein simple hangar brackets, also are mounted on the grooved posts to hold items (not shown) to be displayed. These struts 12 and brackets 17 can be moved to various positions relative to the posts, by engaging them with various slots 13 in the mounting grooves 15. Illustrative connecting elements 18 and 19 are shown in FIG. 5, each comprising a tab that can be inserted through a slot 13 and having a notch 20, 21 in the underside of the tab for fitting downward over the lower edge of the slot's bottomwall 14 when the tabs are properly inserted. An upper abutment wall 22 is provided on the upper tab 18 for engaging the inner side 23 of the bottom wall 14 of the groove. This wall cooperates with the walls of the notches 20 and 21 and with a downward extension wall 24 from the upper notch 20 to hold the bracket 17 firmly in place on the post.

As described in the aforesaid patents, the longitudinal mounting grooves 15 in the posts partially conceal or "mask" the slotted bottom walls 14, which also may be made black or another dark color. This provides an attractive post for merchandising displays and other structures, particularly when a decorative finish is applied to the outer sides of the posts and the struts, with great versatility as to the different arrangements that may be designed. In addition, grooves 16 are formed in the edges of the struts 12, in alignment with the grooves 15 in the posts. Panels (not shown) can be mounted in these grooves to form walls of display structures.

In accordance with the present invention, the posts 10 are specially designed to obtain significantly higher strength from relatively light weight material, and to simplify the manufacturing process, for both economy of manufacture and for versatility in use. To these ends, the posts are made up of at least two elongated thin-wall strips indicated generally by the reference number 25, each of which is bent to form at least one grooved side of the post and to form special interfitting corner shapes. These corner shapes are secured together to form at least two corner bends for adding significant strength and stiffness to the post while securing the strips together.

As can be seen in FIGS. 2, 3 and 4, the post of the preferred embodiment comprises only two such strips 25, these being V-shaped in general cross-sectional shape and each forming two grooved sides of the post. Each strip 25 has one longitudinal edge portion that is formed into a narrow channel-shaped bend 27 to define a joint groove 28 that is approximately the width of the thin-wall metal. The opposite longitudinal edge portion of the strip is bent outwardly to form a narrow strip 29, or tongue, for fitting into the joint groove in an adjacent channel-shaped bend.

An important aspect of the invention is the fact that the two strips 25 that form the post may be identical, being formed as different portions of the same multiple-length strip (FIGS. 12–14) and then cut to the desired length to form the post. One strip is turned end-for-end and fitted against the other with the joint-forming tongues and grooves interfitting (FIGS. 14–16). Then the joints are stitched together as indicated at 30 in FIG. 16, and the post structure is complete.

In more detail, each post strip 25 of the preferred embodiment of the novel post of this invention comprises two U-shaped bends positioned to define two centrally located, outwardly opening grooves 15, each formed between two flat sidewalls 31 that are joined to the two joint-forming edge portions 27 and 29 by a pair of angled corner walls 32 and 33 forming a beveled corner on the post. The joint-forming edge portions 27 and 29 project outwardly from the beveled corners, substantially perpendicular thereto.

For symmetrical appearance, increased strength and enhanced structure as shown in FIGS. 2 and 3, the right-angle bend of each V-shaped strip 25 has the same beveled corner as the joint-forming corner, including a channel-shaped bend 34 between two angled corner walls 35. The bends 34 are optional but preferred because of their contribution to the strength of the post.

Figure 6:
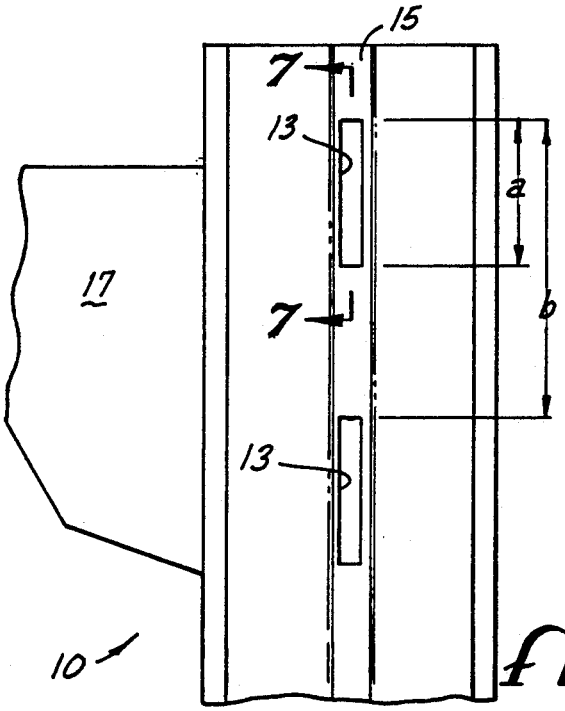
FIG. 6 is a fragmentary side elevational view taken along the line 6—6 of FIG. 3.
Figure 7:
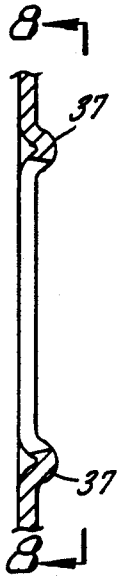
FIG. 7 is an enlarged fragmentary cross-sectional view taken along the line 7—7 of FIG. 6.
Figure 8:
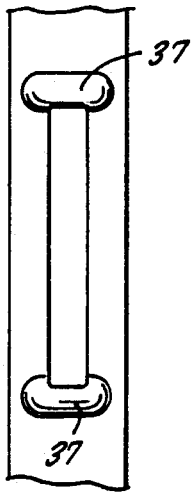
FIG. 8 is an enlarged fragmentary side elevational view taken along the line 8—8 of FIG. 7.

The configuration of the slots 13 can be seen in part at the top of FIGS. 2 and 4 and in more detail in FIGS. 5, 6, 7 and 8. FIG. 6 is a view into one of the mounting grooves 15, showing that the slots 13 are elongated and rectangular in shape, being somewhat wider than the thickness of the material of the tabs 18 and 19 on the brackets 17, and FIG. 5 shows that the slots are somewhat longer than the width of these tabs in the slots, leaving room for manipulation of the tabs into position in the slots. As indicated by the dimension line a in FIG. 7, the length of the slots in a heavy-duty system typically will be one inch, and the spacing, indicated by the dimension line b, will be two inches, referred to as spacing "on two-inch centers". For the lighter weight hardware, the dimension a often is one-half inch and the dimension b is one inch. It is to be understood, however, that these dimensions are illustrative of widely used standard hardware systems, and are not limitations of this invention.

To adapt the thin-wall posts 10 for use with hardware designed for thicker material, the present invention utilizes at least one offset bead 37 (see FIGS. 8 and 9) at one end of each slot so that the outwardly facing surface 38 of the upper tab 18 will firmly engage the inner side 23 of the bottom wall 14 while the inwardly facing end surface 24 of the bracket 17 engages the outer side of the bottom wall. In effect, these beads thicken the bottom wall at the end of the slot. In addition, the offsetting of the metal to form the bead significantly increases the wall strength, which also is important. To provide for endwise reversability of the strips 25, the offset beads 37 are formed at both ends of each slot 13. This insures firm engagement of the lower tab 19 with the grooved bottom wall 14 as well.

Figure 11:
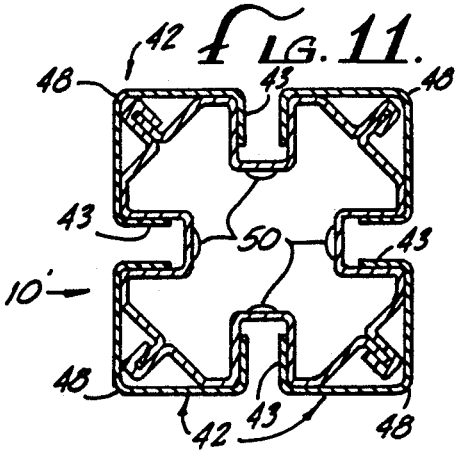
FIGS. 10 and 11 are views similar to FIG. 9 with rounded and generally right-angle corner covers applied to the posts and also illustrating the four-strip alternative embodiment of the post in which a joint is formed at each corner.
Figure 9:
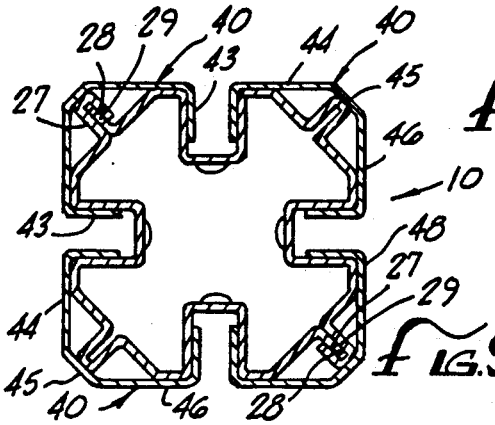
FIG. 9 is a cross-sectional view similar to FIG. 3 with flat-sided corner covers installed, producing an octagonal cross-sectional shape.
Figure 10:
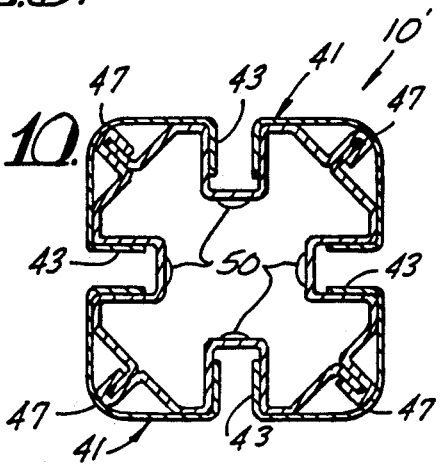

Illustrated in FIGS. 4 and 9–11 are three different decorative corner covers 40, 41 and 42 for use on the posts 10 of the invention, to improve their appearances and to impart different outside shapes to be posts. Each of the covers is an elongated strip, typically composed of sheet metal and the same length as the post 10, and having two edge strips 43 at ninety-degree angles to each other and spaced to firmly engage two adjacent sidewalls of two adjacent mounting grooves, as shown in FIGS. 9–11. All of the edge strips of the three different cover configurations are the same. Between each pair of edge strips 43 is a contoured corner portion having the shape desired for the post between each pair of grooves. In FIG. 9, each cover 40 has three flat sides 44, 45 and 46, so that the resulting post is octagonal or flat-sided with beveled corners. In FIG. 10, the cover's corners 47 are substantially rounded, and in FIG. 11, the corners 48 are less rounded so that the cross-section is almost square.

Alternative Post Construction (FIGS. 10 and 11)

As shown in FIGS. 10 and 11, the post, indicated generally at 10′, can be made in four substantially flat strips 50 rather than the two V-shaped strips 25 of the preferred embodiment. The only structural difference is replacement of the corner bends 34 of the preferred embodiment by two joint-forming elements 27 and 29 as at the other corners of the post. Each side of the post now is formed by a single-sided strip 50. In all other respects, this post 10′ is the same as the post 10 of the preferred embodiment.

The Method of The Invention (FIGS. 12–18)

The steps of the method of the invention should be evident from the foregoing description but will be summarized in connection with FIGS. 12–18. First, a flat strip of metal (not shown) many times the length of the post to be formed is provided, and is bent, usually in a rolling operation, to the shape shown in FIG. 12 for a post in accordance with the preferred embodiment. This shape includes two of the U-shaped grooves 15, the channel-shaped joint-forming bend 27 along one side, and the tongue-forming edge portion 29 along the other side. The bottom walls 14 may be slotted at this stage (FIG. 13), and the offset beads 37 formed at the ends of the slots.

Then the central channel-shaped bend 34 is formed as the strip is bent into a generally "V" shape (FIG. 14), and the strip is cut into substantially identical pieces 25 of the desired length, such as eight feet or ten feet. Two such pieces 25 are paired, and one is turned end-for-end (FIG. 15) to align the joint-forming elements 27 and 29. These then are fitted together (FIG. 16), and are joined together, herein by stitching, which is the formation of the embossed offset points 30 at intervals along the length of the post. Spot-welding or other bonding methods also can be used.

At this stage, the post 10 is structurally complete. For an improved appearance, corner covers 40, 41 or 42 of the same length as the post can be slipped endwise onto the post, as shown in FIG. 17. The method for the alternative embodiment (FIG. 18) is the same, except that the starting material is a narrow flat strip, and is formed with only one U-shaped groove 15 generally centered in the strip between two joint-forming edge portions 27 and 29. Four pieces of equal length (two turned end-for-end) are fitted together and stitched or otherwise joined, to form a post 10' that is essentially the same as the post 10, except for the two extra joints.

From the foregoing, it will be seen that the present invention provides a thin-wall post 10, 10' that is relatively simple in construction but significantly reinforced in strength, and at the same time adaptible for use with heavy duty hardware designed for thicker-walled metal. The specially bent contour provides four slotted grooves in the sidewalls of the preferred square post, with special corner configurations that provide the necessary strength. Indeed, the enhanced strength enables a lightweight, sixteen gauge post carry loads that previously required the heavier eleven gauge material. Moreover, the effective thickening of the walls makes possible the use of hardware designed for the heavier material. Finally, the novel post design makes it possible to use identical sections of one strip, cut to length and turned end-for-end for economy of manufacture. As a result, the present invention is both economical and highly effective. It will be apparent that various modifications and changes may be made without departing from the spirit and scope of the invention.

I claim as my invention:

1. An elongated, decorative post for use in a structural system for merchandise displays and the like, comprising:

two elongated, one-piece sheet metal strips each bent to form two sides of the post with a longitudinal accessory-mounting groove extending down each of the sides of the post, each of said strips comprising:

a central channel-shaped bend defining inwardly opening corner channel inside an outwardly projecting corner rib, two corner strips on opposite sides of said channel-shaped bend and lying in a common plane substantially normal to said corner rib, two outwardly opening, generally U-shaped bends on opposite sides of said corner strips defining the mounting groove and each having two inwardly extending sidewalls and a bottom wall connecting the inner ends of said side walls to form the bottom of the mounting groove, each of said bottom walls having a series of longitudinally elongated, longitudinally spaced mounting slots therein and an inwardly offset, integral bead at the end of each of said slots substantially increasing the effective thickness of the bottom walls at each end of each slot, two side strips on opposite sides of each of the outwardly opening U-shaped bends integrally joining the sidewalls of the mounting grooves to the adjacent corner strips, a second channel-shaped bend along one free edge portion of the strip defining a joint channel opening inwardly toward the opposite free edge portion of the strip, and an integral, outwardly bent joint strip along said opposite free edge portion aligned with the joint channel;

one of said elongated sheet metal strips being turned end-for-end and engaged with the other of said strips with said joint strips in said joint channels;

and stitched joints securing said joint strips in said joint channels.

2. An elongated, decorative post as defined in claim 1 further including decorative corner covers for said post each comprising an elongated strip having a central bend forming a contoured corner for said post, and two inturned edge strips converging at a right angle and spaced to fit tightly against the adjacent sidewalls of two mounting grooves in adjacent sides of said post.

3. An elongated decorative post as defined in claim 2 wherein said contoured corners are generally right angles to form a square post.

4. An elongated decorative post as defined in claim 2 wherein said contoured corners are rounded.

5. An elongated decorative post as defined in claim 2 wherein said contoured corners are beveled to form an octagonal post.

6. An elongated decorative post as defined in claim 1 wherein said sheet metal has a thickness on the order of sixteen gauge metal, and said offset beads increase the effective thickness to on the order of eleven gauge metal.

7. An elongated post for use in a structural system for displays and the like, comprising:

a first elongated sheet metal strip of generally V-shaped transverse cross-sectional shape comprising two side sections disposed generally in planes disposed at a right angle to each other and being bent to define a central longitudinal groove of U-shaped cross-section in each side section disposed between substantially flat side strips forming the central portions of the two side sections, each groove having a bottom wall formed with a series of longitudinally spaced mounting slots;

a channel-shaped bend formed integrally with said sheet metal strip along one free edge thereof and defining a joint channel opening inwardly toward the opposite free edge of the sheet metal strip, said opposite free edge being bent outwardly away from said joint channel to form a joint tongue in substantially the same plane as the joint channel;

a second elongated sheet metal strip substantially identical to said first sheet metal strip and turned end-for-end to align the joint channel of the second strip with the joint tongue of the first strip, said first and second strips being fitted together with said joint tongues in said joint channels;

and means securing said tongues in said channels to form the post.

8. An elongated post as defined in claim 7 wherein each of said sheet metal strips has an integral channel-shaped bend joining said side sections together and having the same external shape and position as the channel-shaped bends defining the joint channels, whereby the four corners of the post have substantially similar external configurations.

9. An elongated post as defined in claim 7 wherein each of said sheet metal strips comprises two separate elongated strips, one for each of said side sections having a channel-shaped bend along one longitudinal edge and a free edge portion forming a joint tongue along the other edge portion, the four strips of the post being substantially identical with the two separate strips of each V-shaped strip being turned end for end and joined together in the same fashion as the V-shaped strips.

10. The improved post defined in claim 7 further including an offset bead at one end of each slot in said bottom walls substantially thickening said thin-wall material at said upper ends.

11. The improved post defined in claim 10 wherein said beads are offset a distance approximately equal to the thickness of the material, thereby approximately doubling the effective thickness of said material at said upper ends.

12. The improved post defined in claim 10 in which an offset bead is provided at both ends of each of said slots, whereby said strips may be produced identically before being turned end-for-end.

13. The improved post defined in claim 7 further including four elongated corner covers for said post, each of said corner covers comprising an elongated channel extending the length of the post and having one longitudinal edge portion lying in one of said grooves, a second longitudinal edge portion lying in an adjacent groove, and a contoured corner portion extending around the corner between the grooves, said longitudinal edge portions of each corner cover extending at right angles to each other into the respective grooves in tight engagement with the sidewalls of the grooves forming the covered corner portion, thereby securing the corner covers in place on said post.

14. The improved post defined in claim 13 wherein said contoured corner portions are substantially right angles forming a substantially square post.

15. The improved post defined in claim 13 wherein said contoured corner portions are rounded, forming a post with rounded corners.

16. The improved post defined in claim 13 wherein each of said contoured corner portions has two legs disposed at right angles and joined by a beveled corner surface, thereby forming a generally octagonal post.

17. In an elongated hollow post for use in a structural system for displays and the like and defining a plurality of longitudinal grooves angularly spaced apart around the post, each groove being defined by two inwardly extending sidewalls and a bottom wall, and each of said bottom walls having a series of longitudinally spaced slots for receiving accessories to be supported on the post, the improvement in which said post comprises:

two elongated, one-piece strips of relatively rigid, thin-wall sheet material having identical cross-sectional shapes including two free longitudinal edge portions, one of said edge portions being channel-shaped and the other edge portion forming a tongue sized to fit closely within the channel-shaped edge portion of an adjacent strip, and each of said strips having two side sections joined to each other at a right angle by an integral bend, between the edge portions thereof, and each side section defining one of said grooves therein opening laterally out of said strip, the adjacent strip being turned end-for-end to align the tongue thereof with the channel-shaped edge portion of the other and said strips being fitted together into said hollow elongated post, and means forming joints between said tongues and said channel-shaped portions securing said edge portions together.

18. The improved post defined in claim 17 wherein said means forming joints comprise embossed offset points in the tongues and the channel-shaped portions spaced apart longitudinally along the post to form stitched joints.

19. The improved post defined in claim 17 wherein said integral bends have substantially the same shape as said channel-shaped edge portions and are positioned to form two ridges on said post equidistant from said channel-shaped edge portions.

20. The improved post defined in claim 17 wherein said strips have a pair of outer walls on opposite sides of each of said grooves and integrally joined to the sidewalls of the groove between them to form a side of the generally rectangular post, each of said sides of the post being joined to the adjacent sides of the post by outer walls forming corner bevels, two such corner bevels having said joints thereon.

21. The improved post defined in claim 17 further including an offset bead at one end of each slot in said bottom walls substantially thickening said thin-wall material at said upper ends.

22. The improved post defined in claim 21 wherein said beads are offset a distance approximately equal to the thickness of the material, thereby approximately doubling the effective thickness of said material at said upper ends.

23. The improved post defined in claim 21 in which an offset bead is provided at both ends of each of said slots, whereby said strips may be produced identically before being turned end-for-end.

24. The method of forming decorative posts for use in structural systems such as merchandise displays and the like comprising the steps of:

providing an elongated strip of thin-wall sheet metal of predetermined width;

bending the strip to form at least one generally U-shaped mounting groove therein with two integral side strips on opposite sides of said groove, a corner strip extending laterally from each side strip, and an edge portion integrally joined to each side strip;

bending the edge portions of the strip to form a longitudinal channel-shaped joint groove along one edge portion and a longitudinal joint tongue along the other edge portion and bending the strip to position said joint groove to be aligned with the joint tongue when pieces of the strip are turned end-for-end;

forming a series of longitudinally spaced slots in said mounting groove;

cutting said strip to form a plurality of pieces of a predetermined length;

turning one-half of the pieces end-for-end to align the joint grooves and joint tongues, and fitting the pieces together to form posts;

and securing the joint tongues in the joint grooves.

25. The method defined in claim 24 wherein the securing step is performed by stitching.

26. The method defined in claim 24 wherein the first-mentioned bending step includes the formation of two laterally spaced U-shaped mounting grooves integrally joined together by the central portion of said elongated strip; and further including the step of bending said central portions to form a corner bend forming a right angle between the planes of the opposite edge portions thereof;

and wherein two pieces are joined together to form a rectangular post.

27. The method defined in claim 26 wherein said corner bend is formed to have substantially the same external configuration as said joint channels.

28. The method defined in claim 24 including the further step of offsetting the metal at each end of each of said slots to increase the effective thickness of the metal.

* * * * *